US007671699B2

(12) United States Patent
Wren

(10) Patent No.: US 7,671,699 B2
(45) Date of Patent: Mar. 2, 2010

(54) COUPLER

(75) Inventor: Michael Wren, Dublin (IE)

(73) Assignee: Pine Valley Investments, Inc., Las Vegas, NV (US)

( * ) Notice: Subject to any disclaimer, the term of this patent is extended or adjusted under 35 U.S.C. 154(b) by 87 days.

(21) Appl. No.: 11/838,856

(22) Filed: Aug. 14, 2007

(65) Prior Publication Data

US 2009/0045888 A1 Feb. 19, 2009

(51) Int. Cl.
*H01P 5/12* (2006.01)
*H01P 5/18* (2006.01)

(52) U.S. Cl. ..... 333/109; 333/116

(58) Field of Classification Search ..... 333/246, 333/26, 109, 110, 111, 112, 113, 114, 115, 333/116
See application file for complete search history.

(56) References Cited

U.S. PATENT DOCUMENTS

| | | | | |
|---|---|---|---|---|
| 3,516,024 | A | 6/1970 | Lange | |
| 4,369,390 | A | 1/1983 | Malocha et al. | |
| 5,056,109 | A | 10/1991 | Gilhousen et al. | |
| 5,257,283 | A | 10/1993 | Gilhousen et al. | |
| 5,265,119 | A | 11/1993 | Gilhousen et al. | |
| 5,267,262 | A | 11/1993 | Wheatley, III | |
| 5,396,516 | A | 3/1995 | Padovani et al. | |
| 5,452,473 | A | 9/1995 | Weiland et al. | |
| 5,485,486 | A | 1/1996 | Gilhousen et al. | |
| 5,590,408 | A | 12/1996 | Weiland et al. | |
| 5,655,220 | A | 8/1997 | Weiland et al. | |
| 5,661,434 | A | 8/1997 | Brozovich et al. | |
| 5,703,902 | A | 12/1997 | Ziv et al. | |
| 5,758,269 | A | 5/1998 | Wu | |
| 5,903,554 | A | 5/1999 | Saints | |
| 5,974,041 | A | 10/1999 | Kornfeld et al. | |
| 6,075,974 | A | 6/2000 | Saints et al. | |
| 6,178,313 | B1 | 1/2001 | Mages et al. | |
| 6,185,432 | B1 | 2/2001 | Vembu | |
| 6,191,653 | B1 | 2/2001 | Camp, Jr. et al. | |
| 6,194,963 | B1 | 2/2001 | Camp, Jr. et al. | |
| 6,259,928 | B1 | 7/2001 | Vembu | |
| 6,272,336 | B1 | 8/2001 | Appel et al. | |
| 6,320,913 | B1 | 11/2001 | Nakayama | |
| 6,330,462 | B1 | 12/2001 | Chen | |
| 6,351,650 | B1 | 2/2002 | Lundby et al. | |
| 6,370,109 | B1 | 4/2002 | Schwartz et al. | |
| 6,374,085 | B1 | 4/2002 | Saints et al. | |
| 6,421,327 | B1 | 7/2002 | Lundby et al. | |
| 6,490,460 | B1 | 12/2002 | Soliman | |
| 6,496,708 | B1 * | 12/2002 | Chan et al. | 455/553.1 |
| 6,628,165 | B1 | 9/2003 | Henderson et al. | |
| 6,701,134 | B1 | 3/2004 | Epperson | |
| 6,891,506 | B2 | 5/2005 | Jarmuszewski et al. | |
| 6,952,147 | B2 | 10/2005 | Gurvich et al. | |
| 6,972,638 | B2 * | 12/2005 | Usami et al. | 333/109 |
| 7,010,273 | B2 * | 3/2006 | Satoh et al. | 455/83 |
| 7,119,633 | B2 | 10/2006 | Stoneham | |
| 2003/0073419 | A1 | 4/2003 | Chadwick | |

(Continued)

*Primary Examiner*—Dean O Takaoka
(74) *Attorney, Agent, or Firm*—Darby & Darby PC; Robert J. Sacco

(57) ABSTRACT

Various directional coupler arrangements are disclosed. For instance, an apparatus includes first, second, and third conductive patterns disposed on a substrate. Each of these conductive patterns includes a first end and an opposite second end. Moreover, each of these conductive patterns includes a first protrusion at its first end and a second protrusion at its second end.

11 Claims, 12 Drawing Sheets

U.S. PATENT DOCUMENTS

2003/0223510 A1 12/2003 Kurakami et al.
2004/0192369 A1 9/2004 Nilsson
2005/0030104 A1 2/2005 Chen et al.
2005/0156686 A1 7/2005 Podell

* cited by examiner

300

500

COUPLER

BACKGROUND

Directional couplers are devices that couple a portion of a signal's power in a transmission line to a port that is often called the coupled port. Also, directional couplers typically include an input port and a transmitted port associated with the transmission line, and an isolated port that corresponds to the coupled port.

Various characteristics are used in evaluating the performance of couplers. One of these characteristics is the coupling factor, which is the ratio of signal levels between the input port and the coupled port. Another characteristic is isolation, which is a ratio of signal levels between the input port and the isolated port. A further characteristic, directivity, is a ratio of signal levels between the coupled port and the isolated port. Alternatively, directivity may be expressed as a ratio between the isolation and the coupling factor.

Generally, high isolation and high directivity values are desirable. In contrast, low values typically indicate deficient performance. For instance, as isolation decreases, the amount of power that is "leaked" from the input to the isolated port increases. Also, as directivity decreases, small mismatches on the transmission line can cause variations in coupled power levels.

Existing coupler design techniques result in a prohibitive trade-off between size and performance. For instance, typical couplers providing suitable performance characteristics are large in size (e.g., on the order of a quarter wavelength). Thus, these couplers are too large for applications, such as cellular handsets. Also, despite being somewhat suitable, such large couplers have excessive path lengths, which can cause unwanted losses and undesirable system efficiency.

SUMMARY

The present invention provides various embodiments that may involve directional couplers. For instance, an apparatus may include first, second, and third conductive patterns disposed on a substrate. Each of these conductive patterns includes a first end and an opposite second end. Moreover, each of these conductive patterns includes a first protrusion at its first end and a second protrusion at its second end.

A further apparatus may include first, second, and third conductive patterns disposed on a substrate. The third conductive pattern is to provide a coupled signal that corresponds to a first input signal received at the first conductive pattern and/or a second input signal received at the second conductive pattern. Each of the conductive patterns includes a first end and an opposite second end. Moreover, each of the conductive patterns includes a first protrusion at its first end and a second protrusion at its second end.

Yet a further apparatus may include a first signal path to provide a first radio frequency (RF) signal in a first frequency range, and a second signal path to provide a second RF signal in a second frequency range. In addition, the apparatus may include a coupler. The coupler may have a first conductive pattern to receive the first input signal, a second conductive pattern to the second input signal, and a third conductive pattern to provide a coupled signal based on the first and/or second input signals. Each of the conductive patterns includes a first end and an opposite second end. Moreover, each of the conductive patterns includes a first protrusion at its first end and a second protrusion at its second end.

Still a further apparatus may include a substrate, and first and second conductive patterns disposed on the substrate. Each of the first and second conductive patterns has a first end and an opposite second end. Moreover, each of the first and second conductive patterns includes a first protrusion at its first end and a second protrusion at its second end.

DETAILED DESCRIPTION

Various embodiments may be generally directed to couplers. Such couplers may be structured such that they may be configured (or tuned) to cover a wide range of frequencies. For instance, embodiments may be used for multi-band (e.g., quad-band) cellular operation. Moreover, such couplers may exhibit improved isolation and directivity.

Further, embodiments may be tuned according to multi-element capacitive compensation techniques. For instance, protrusions may be provided at the ends of conductive patterns within the coupler. Such tuning techniques may compensate for unequal phase velocities in coupled lines. For instance, such tuning techniques may add a distributive capacitive effect that increases the effective dielectric constant felt by the odd mode characteristic impedance. As a result, the phase velocity of one or more lines may be reduced. In turn, improved isolation and directivity may be achieved.

Embodiments may employ conductive patterns having path lengths that are significantly less than a quarter-wave length. This feature may advantageously mitigate problematic system efficiency losses. Further, this feature may advantageously provide compact implementations. Accordingly, highly integrated subsystem and system design solutions may be attained.

Although embodiments may be described with a certain number of elements in a particular arrangement by way of example, the embodiments are not limited to such examples. For instance, embodiments may include greater or fewer elements, as well as other arrangements among elements.

Embodiments of the present invention may be employed in a variety of contexts. For instance, embodiments may be employed in contexts involving the transmission of radio frequency (RF) signals. It is often desirable in such contexts to measure the power delivered to a load (e.g., an antenna) in real time. This power measurement may be used as feedback to adjust an amplifier's bias point and/or gain to compensate for varying load and temperature conditions.

Figure 1:
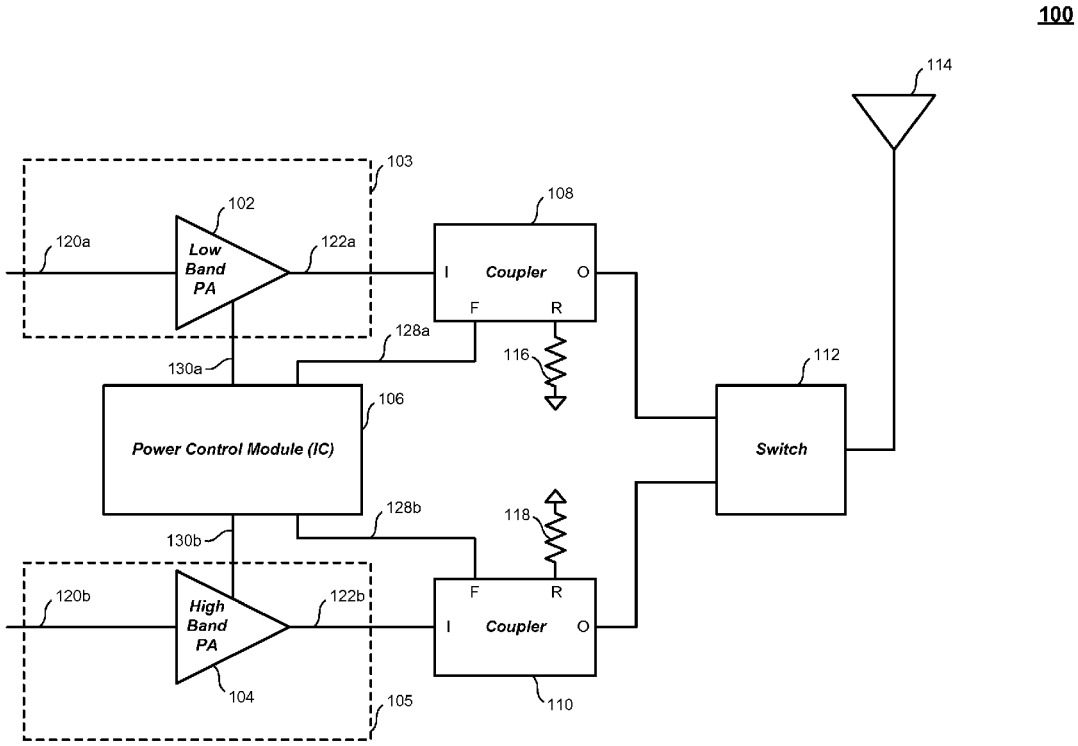
FIG. 1 illustrates a closed-loop power control arrangement.

An example of such a transmission context is illustrated in FIG. 1. In particular, FIG. 1 is a diagram of a transmit module 100 that may be included in various devices and/or systems. For instance, transmit module 100 may be included in a mobile telephone (e.g., a GSM/EDGE phone and/or PCS phone). The embodiments, however, are not limited to such devices or systems.

Transmit module 100 may include various elements. For instance, FIG. 1 shows that transmit module 100 may include a low band power amplifier (PA) 102, a high band PA 104, a power control module 106, a first coupler 108, a second coupler 110, a switch 112, and an antenna 114. These elements may be implemented in hardware, software, firmware, or in any combination thereof.

Transmit module 100 may operate in various frequency bands. Such bands may include the GSM850 band from 824 MHz to 849 MHz, the EGSM900 band from 880 MHz to 915 MHz, the European DCS band from 1710 MHz to 1785 MHz and the PCS band from 1850 MHz to 1910 MHz. Devices having communications capabilities in these bands are referred to as being GSM/EDGE quad-band capable. The embodiments, however, are not limited to operation in these frequency bands.

Low band PA 102 (which is included in a signal path 103) receives a low band signal 120*a* (such as an AMPS or GSM signal) and produces a corresponding amplified low band signal 122*a*. Similarly, high band PA 104 (which is included in a signal path 105) receives a high band signal 120*b* (such as a PCS or DCS signal) and produces a corresponding amplified high band signal 122*b*.

In embodiments, only one of signals 120*a* and 120*b* are received at a particular time. This may be based, for example, on the type of communications network being accessed. However, the embodiments are not so limited. For instance, certain embodiments may receive signals 120*a* and 120*b* simultaneously.

Signals 122*a* and 122*b* pass through couplers 108 and 110 and arrive at switch 112. Based on its setting, switch 112 forwards one of signals 122*a* and 122*b* to antenna 114 for wireless transmission.

As shown in FIG. 1, power control module 106 may be implemented with an integrated circuit (IC). The embodiments, however, are not limited to such implementations. In general operation, power control module 106 controls parameters or settings (e.g., bias point and/or gain) of power amplifiers 102 and 104. Such control may be implemented through control directives or signals. For instance, FIG. 1 shows power control module 106 sending a control signal 130*a* to low band PA 102 and a control signal 130*b* to high band PA 104.

This control is based on feedback signals that power control module 106 receives from couplers 108 and 110. In particular, operation of power control module 106 may be based on a feedback signal 128*a* from coupler 108 and a feedback signal 128*b* from 110. Feedback signal 128*a* corresponds to amplified signal 122*a* and feedback signal 128*b* corresponds to amplified signal 122*b*

As shown in FIG. 1, couplers 108 and 110 each include an input port (I), a transmitted port (O), a coupled port (F), and an isolated port (R). Each coupler's input port receives its corresponding amplified signal (i.e., either signal 122*a* or signal 122*b*). The coupler's transmitted port passes this signal on to switch 112. Together, the input port, the transmitted port, and the connection between them may be referred to as a through line.

Each isolated port R is terminated to ground through a resistance. For instance, FIG. 1 shows a resistance 116 being coupled between the isolated port of coupler 108 and ground, whereas FIG. 1 shows a resistance 118 being coupled between the isolated port of coupler 110 and ground. These resistances may each be matched to the characteristic impedance (e.g., 50 Ohms) associated with the corresponding coupler's isolated port. Although these resistances are shown as being separate from couplers 108 and 110, each of these resistances may be alternatively included in their corresponding coupler.

FIG. 1 further shows that couplers 108 and 110 (at their coupled ports) produce feedback signals 128*a* and 128*b*, respectively. Through this arrangement, signals 128*a* and 128*b* and signals 122*a* and 122*b* may have corresponding characteristics, such as power level and frequency. Thus, the power level and frequency of feedback signal 128*a* may indicate the power level and frequency of amplified signal 122*a*. This principal also applies for feedback signal 128*b* and amplified signal 122*b*.

As a result, transmit module 100 performs power control operations according to a closed-loop arrangement. Moreover, power control module 106 may assess signal 128*a* and 128*b* without interrupting operation of transmit module 100.

Couplers 108 and 110 may be implemented according to the techniques described herein. Accordingly, these couplers may exhibit sufficiently high levels of directivity and isolation. This feature may advantageously reduce or prevent worsening of power control operations through the introduction of any interferers or load mismatches at antenna 114.

As discussed above, component size and cost is of critical importance. To this end, embodiments may provide couplers exhibiting desirable performance characteristics (e.g., high directivity and/or isolation) at sizes (e.g., height, width, length, and so forth) that are suitable for a variety of applications. Thus, in applications such as cellular telephony, greater radio sub-system integration may be achieved. Moreover, embodiments may provide such couplers in a cost feasible manner.

Figure 2A:
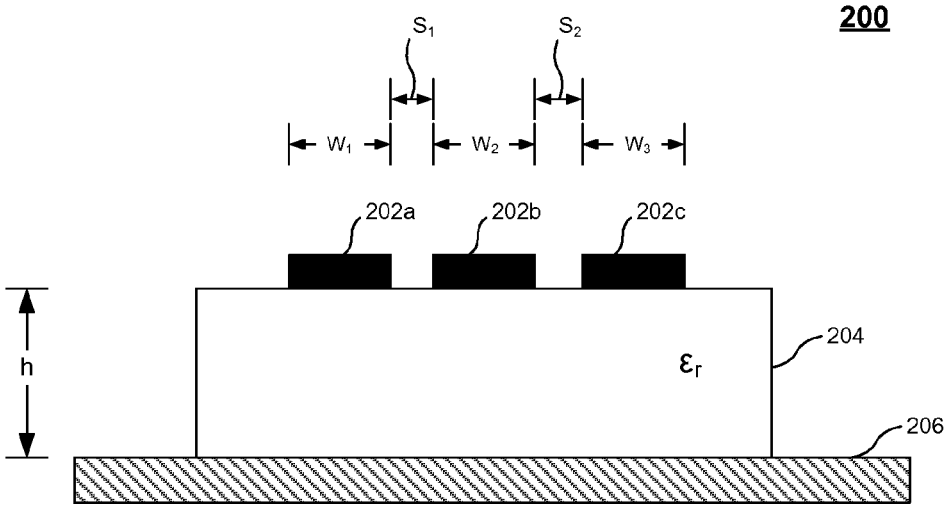
FIGS. 2A and 2B are views of a directional coupler.
Figure 2B:
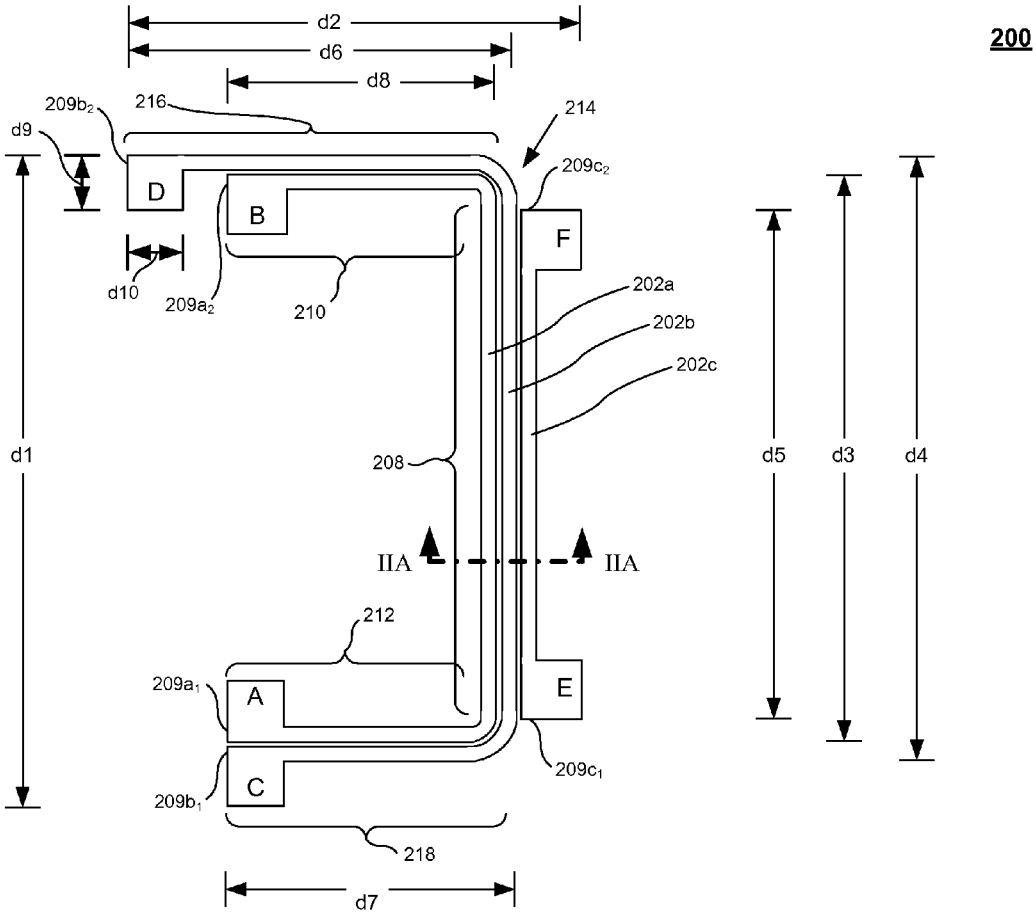

FIGS. 2A and 2B are views of a directional coupler. In particular, FIG. 2A is a cross-sectional view of a microstrip directional coupler embodiment 200. This embodiment may be employed in various contexts, such as the context of FIG. 1. As shown in FIG. 2A, directional coupler 200 includes multiple (e.g., three) conductive patterns 202*a-c*, a substrate 204, and a ground plane 206.

FIG. 2A further shows that substrate 204 has a height h and a dielectric constant $\in_r$. Also, FIG. 2A shows conductive patterns 202*a*, 202*b*, and 202*c* having widths $W_1$, $W_2$, and $W_3$, respectively. Moreover, conductive patterns 202*a* and 202*b* are shown being separated by a spacing $S_1$, while conductive patterns 202*b* and 202*c* are shown being separated by a spacing $S_2$. Values for the widths, spacings, height and dielectric constant are provided below in Table 1. These values are provided as an illustrative example. Accordingly, embodiments may employ other values.

TABLE 1

| | |
|---|---|
| H | 150 um |
| $\epsilon_r$ | 12.9 |
| $W_1$ | 20 um |
| $W_2$ | 22 um |
| $W_3$ | 20 um |
| $S_1$ | 6 um |
| $S_2$ | 5 um |

Conductive patterns 202*a-c* may each be implemented with a single layer of metal. Alternatively, conductive patterns 202*a-c* may each comprise multiple (e.g., three) stacked conductive layers. Each stacked layer may be disposed on a corresponding substrate layer. In turn, one or more vias may provide conductive contact between the conductive layers. Employment of such stacked conductive patterns may increase pattern thickness. As a result, each pattern may achieve an improved quality factor (Q), which may contribute to improved isolation.

Substrate 204 may comprise a dielectric or semiconductor material, such as Gallium Arsenide (GaAs) made in accordance with a standard process. However, other materials may be employed.

Analysis of microstrip directional couplers is relatively complicated when compared to other structures, such as coupled line structures. Coupled line structures may be analyzed according to coupled line theory. Such analysis assumes that, for infinite isolation, the odd and even modes of coupled line structures must have the same velocities of propagation, ($V_{ph}$). In other words, infinite isolation is achieved for a coupled line structure when its lines have identical electrical lengths for both modes.

However, this principle does not apply for microstrip directional couplers. In such couplers, the phase velocity is different for each case as the modes operate with different electric field configurations in the vicinity of the air-dielectric interface. As a result, conventional microstrip directional couplers suffer from poor directivity/isolation.

To improve directivity and isolation, embodiments may employ multi-element capacitive compensation (also referred to herein as multi-element capacitive tuning). This may involve including additional conductive material at the ends of conductive lines (e.g., at the ends of each of patterns 202*a-c*). Such additional conductive material may effectively compensate for the unequal phase velocities in the coupled lines. Additionally, such additional material may increase the effective dielectric constant felt by the odd mode characteristic impedance. As a result, a reduction in phase velocity occurs. This provides improved isolation, and hence improved directivity.

The additional conductive material may be implemented in various ways. One exemplary implementation involves including protrusions of additional conductive material (e.g., blocks of metal track) with the conductive patterns. Each protrusion is positioned a particular location (e.g., an end) of a corresponding conductive pattern or line. The protrusions may have various shapes. For instance, rectangular protrusions may be employed. The embodiments, however, are not limited to this shape.

FIG. 2B is a top layout view of coupler embodiment 200. This view shows coupler embodiment 200 employing multi-element capacitive compensation or tuning, as described herein. Moreover, coupler 200 may provide effective performance in multiple different frequency bands. As shown in FIG. 2B, each of conductive patterns (or lines) 202*a*-202*c* has two opposite ends. For instance, conductive pattern 202*a* includes opposite ends $\mathbf{209}a_1$ and $\mathbf{209}a_2$, conductive pattern 202*b* includes opposite ends $\mathbf{209}b_1$ and $\mathbf{209}b_2$, and conductive pattern 202*c* includes opposite ends $\mathbf{209}c_1$ and $\mathbf{209}c_2$.

Conductive patterns 202*a* and 202*c* may receive signals in different frequency bands. In turn, conductive pattern 202*c* may output corresponding coupled signals. FIG. 2B shows that conductive pattern 202*a* is larger in size than conductive pattern 202*c*. Thus, conductive pattern 202*a* may receive signals in lower frequency bands or ranges, and conductive pattern 202*c* may receive signals in higher frequency bands or ranges. Exemplary lower frequency bands include AMPS and GSM/EGSM bands, while exemplary higher frequency bands include PCS and DCS bands.

Thus, coupler 200 is a six-port edge coupled device having an electrical length, θ, that is substantially less than a quarter wavelength ($\theta \ll \lambda/4$). Although not shown, pattern 202*b* may be terminated with an isolation termination (e.g., a 50 ohm termination). Such a termination may enhance overall electrical performance. Terminations such as this may be included in coupler 200.

As shown in FIG. 2B, conductive patterns 202*a* and 202*b* each have a "C" shape, while conductive pattern 202*c* is substantially linear. For each of conductive patterns 202*a* and 202*b*, the C shape includes a center portion that is between two opposing side portions. For instance, FIG. 2B shows conductive pattern 202*a* having a center portion 208, a first side portion 210, and a second side portion 212. Similarly, conductive pattern 202*b* is shown having a center portion 214, a first side portion 216, and a second side portion 218.

FIG. 2B further shows that patterns 202*a-c* each include protrusions at their ends. Such protrusions may have various shapes and forms. However, for purposes of illustration, FIG. 2B shows these protrusions as blocks. For instance, conductive pattern 202*a* includes a block A at end $\mathbf{209}a_1$ and a block B at end $\mathbf{209}a_2$. Similarly, conductive pattern 202*b* includes a block C at end $\mathbf{209}b_1$ and a block D at end $\mathbf{209}b_2$. Likewise, conductive pattern 202*c* includes a block E at end $\mathbf{209}c_1$ and a block F at end $\mathbf{209}c_2$.

As described above, embodiments may employ protrusions having shapes other than rectangles. Moreover, embodiments may employ protrusions of various sizes, orientations, and/or relative locations. By modifying and tuning the shape, size, orientation, and/or relative location each of these blocks, the electromagnetic field interaction between patterns 202*a-c* may be refined to yield enhanced electrical performance.

Various dimension are shown in FIG. 2B. For instance, coupler 200 is shown having a substantially rectangular footprint of dimensions d1 by d2. Further, FIG. 2B shows each of blocks A-F as being substantially rectangular and having dimensions d9 by d10.

For conductive pattern 202*a*, portion 208 is shown having a length d3, while portions 210 and 212 each have a length d8. With respect to conductive pattern 202*b*, portion 214 of is shown having a length d4, while portions 216 and 218 have lengths d6 and d7, respectively. Also, FIG. 2B shows conductive pattern 202*c* having a length d5.

Exemplary values of these dimensions are provided below in Table 2. However, it is worthy to note that these dimensions are provided as examples, and not as limitations. Moreover, embodiments may include various other shapes and orientations than those illustrated in FIGS. 2A and 2B.

TABLE 2

| | |
|---|---|
| d1 | 886 um |
| d2 | 615 um |
| d3 | 771 um |
| d4 | 827 um |
| d5 | 690 um |
| d6 | 529 um |
| d7 | 391 um |
| d8 | 363 um |
| d9 | 77 um |
| d10 | 77 um |

Coupler 200 differs from conventional coupler designs in various ways. For example, conventional coupler designs that employ broad-side or edge-side coupling are constructed using multi-layer laminate substrate technology (such BT or FR-4 printed circuit board substrates). Other conventional designs employ high frequency ceramics. Regardless, such conventional designs utilize the electromagnetic coupling between two adjacent transmission lines having quarter wavelength electrical lengths. The spacing between the transmission lines is chosen to yield the desired coupling factor. However, as discussed above, the overall size or area consumed by such designs may be too large, as well as too costly. Moreover, the electrical performance of such conventional designs is less than desirable. This may attributed to factors, such as insertion losses, poor directivity, and/or other characteristics.

Figure 3:
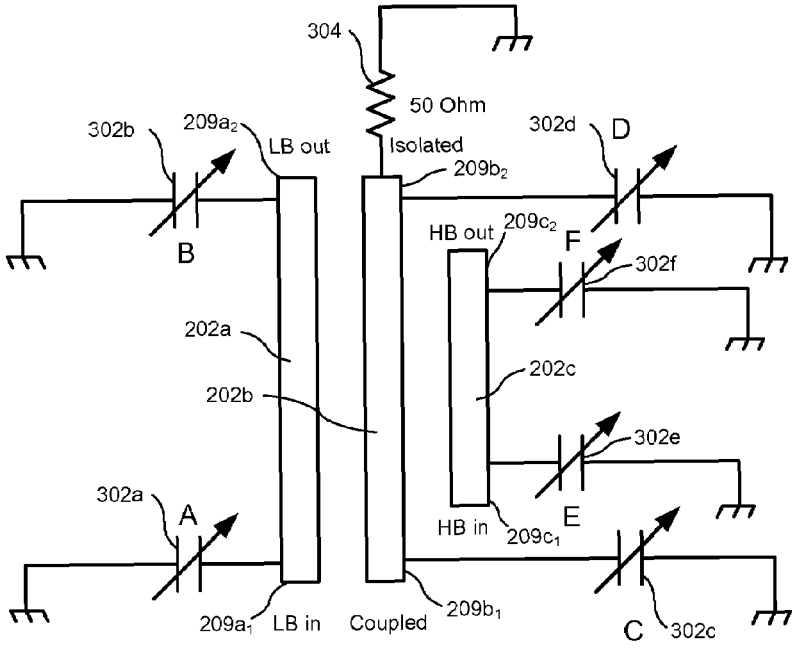
FIG. 3 is an equivalent circuit schematic for the directional coupler of FIGS. 2A and 2B.

FIG. 3 is a schematic of a circuit 300, which is a lumped equivalent circuit of coupler 200. As shown in FIG. 3, circuit 300 includes multiple capacitances. For instance, equivalent circuit 300 includes a capacitance 302*a* at a first end 209$a_1$ of pattern 202*a*, and a capacitance 302*b* at second end 209$a_2$ of pattern 202*a*. Also, equivalent circuit 300 includes a capacitance 302*c* at first end 209$b_1$ of pattern 202*b*, and a capacitance 302*d* at second end 209$b_2$ of pattern 202*b*. In addition, equivalent circuit 300 includes a capacitance 302*e* at first end 209$c_1$ of pattern 202*c*, and a capacitance 302*f* at second end 209$c_2$ of pattern 202*c*.

Also, FIG. 3 shows a terminating resistance 304 coupled between pattern 202*b* and ground at end 209$b_2$.

Capacitances 302*a-f* have values that are based on blocks A-F, respectively. FIG. 3 indicates these capacitance values as being variable. These capacitance values may be varied by changing in the characteristics (e.g., size, shape, relative position, and so forth) of their corresponding blocks A-F.

FIG. 3 shows ports being associated with conductive patterns 202*a-c*. For instance, conductive pattern 202*a* is shown having a low band input port (LB in) at end 209$a_1$ and a low band output port (LB out) at end 209$a_2$. Similarly, conductive pattern 202*c* is shown having a high band input port (HB in) at end 209$c_1$ and a high band output port (HB out) at end 209$c_2$. Also, conductive pattern 202*b* is shown having a coupled port at end 209$b_1$ and an isolated port at end 209$b_2$. Thus, conductive pattern 202*a* provides a low band through pattern, and conductive pattern provides a high band through line.

Figure 4:
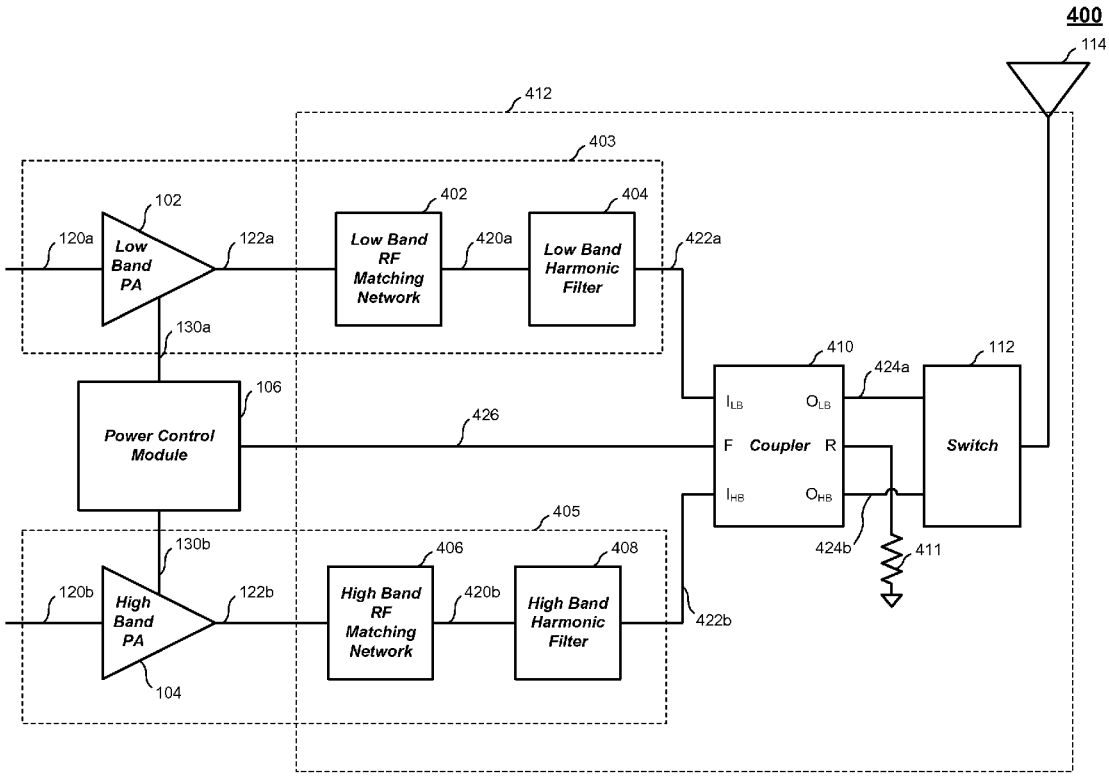
FIG. 4 illustrates a quad-band transmit/receive front end module.

FIG. 4 is a block diagram of a transmit module implementation 400 that may also employ a coupler, such as coupler 200. Like the implementation of FIG. 1, transmit module 400 may be included in various devices and/or systems, such as a mobile telephone (e.g., a GSM/EDGE and/or PCS phone). The embodiments, however, are not limited to such devices or systems.

Transmit module 400 is similar to the implementation of FIG. 1. For instance, FIG. 4 shows transmit module 400 including low band PA 102, high band PA 104, power control module 106, switch 112, and antenna 114. Additionally, FIG. 4 shows transmit module 400 including a low band RF matching network 402, a low band harmonic filter 404, a high band RF matching network 406, a high band harmonic filter 408, and a coupler 410.

Further, FIG. 4 shows signal paths 403 and 405. As shown in FIG. 4, signal path 403 includes low band PA 102, low band RF matching network 402, and low band harmonic filter 404. However, FIG. 4 shows signal path 405 including high band PA 104, high band RF matching network 406, and high band harmonic filter 408.

As described above, low band PA 102 receives a low band signal 120*a* (such as an AMPS or GSM signal) and produces a corresponding amplified low band signal 122*a*. Similarly, high band PA 104 receives a high band signal 120*b* (such as a PCS or DCS signal) and produces a corresponding amplified high band signal 122*b*.

In embodiments, only one of signals 120*a* and 120*b* are received at a particular time. This may be based, for example, on the type of communication network being accessed. However, the embodiments are not so limited. For instance, certain embodiments may receive signals 120*a* and 120*b* simultaneously.

FIG. 1 shows that signals 122*a* and 122*b* are sent to low band RF matching network 402 and high band RF matching network 406, respectively. Matching networks 402 and 406 provide impedance matching for PAs 102 and 104. Thus, these matching networks produce signals 420*a* and 420*b*, which are sent to harmonic filters 404 and 408, respectively.

Harmonic filters 404 and 408 provide band pass filtering for signals 420*a* and 420*b*. This filtering produces a low band filtered signal 422*a* and a high band filtered signal 422*b*. As shown in FIG. 4, coupler 410 receives low band filtered signal 422*a* at an input port $I_{LB}$, and receives high band filtered signal 422*b* at an input port $I_{HB}$.

Further, FIG. 4 shows that coupler 410 outputs signal 424*a* at an output port $O_{LB}$ and outputs signal 424*b* at an output port $O_{HB}$. Thus, coupler 410 provides two through lines: one for low band filtered signal 424*a* and one for high band filtered signal 424*b*.

In addition, coupler 410 includes a coupled port (F), and an isolated port (R). Coupled port provides a feedback signal 426 to power control module 106. Feedback signal 426 has characteristics (such as power level and frequency) corresponding to signals 424*a* and/or 424*b*. Based on this feedback signal, power control module 106 may control parameters or settings (e.g., bias point and/or gain) of power amplifiers 102 and 104. As described above, this control may be implemented through control signals 130*a* and 130*b*.

FIG. 4 shows that signals 422*a* and 422*b* are sent to coupler 410 and arrive at switch 112 as signals 424*a* and 424*b*. Based on its setting, switch 112 forwards one these signals to antenna 114.

FIG. 4 shows isolated port R being terminated to ground through a resistance 411. This resistance may be matched to the characteristic impedance of isolated port R. Although resistance 411 is shown being separate from coupler 410, it may be alternatively included in coupler 410.

Coupler 410 may be implemented according to the techniques described herein. For example, coupler 410 may be implemented as described above with reference to FIGS. 2A and 2B. For instance, conductive pattern 202*a* may provide a through line for low band filtered signal 424*a* and conductive pattern 202*c* may provide a through line for high band filtered signal 424*b*. Further conductive pattern 202*b* may provide a line for coupled port F and isolated port R. However, the embodiments are not limited to this particular implementation. Thus, embodiments may employ various other arrangements.

Moreover, FIG. 4 shows that various elements are included in a module 412. In embodiments, module 412 may be a single printed circuit board (PCB) implementation. Thus, the elements within module 412 may share a substrate. With reference to FIGS. 2A and 2B, this substrate may be substrate 204. The embodiments, however, are not limited to this context.

Figure 5:
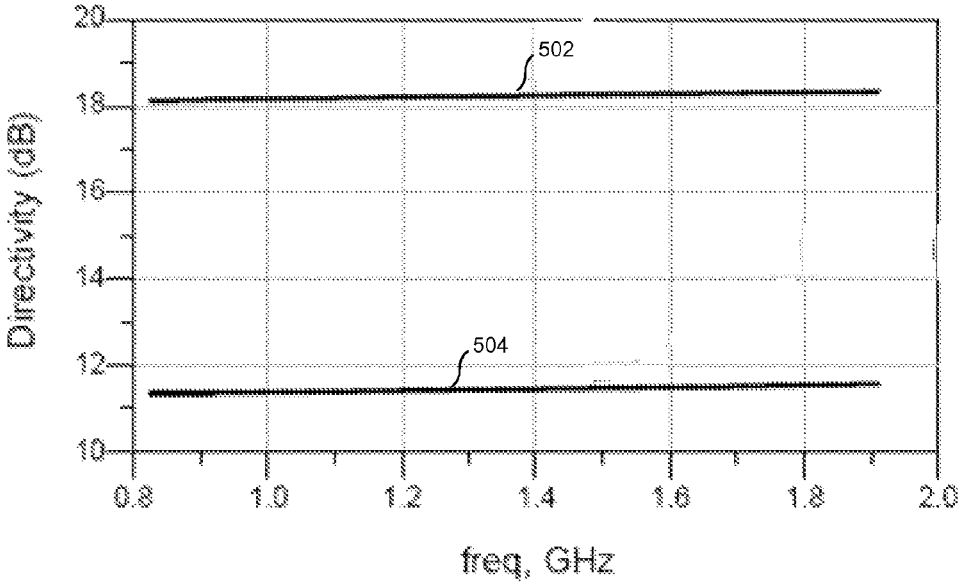
FIG. 5 is a graph showing directivity characteristics of directional couplers.

FIG. 5 is a graph 500 showing directivity characteristics of directional couplers with respect to operational frequency. As shown in FIG. 5, graph 500 includes curve 502, which corresponds to the microstrip coupler implementation of FIGS. 2A and 2B. Additionally, graph 500 includes a curve 504 that corresponds to a coupler implementation that is similar, but does not include the protrusions of conductive patterns 202*a-c*. Both of these curves indicate directivity across a range of frequencies from approximately 0.8 GHz to approximately 2.0 GHz. These results were obtained through computer simulation.

Curve 504 indicates a directivity of approximately 11 dB across this frequency range. However, curve 502 indicates an improved directivity of approximately 18 dB across this frequency range.

Figure 6:
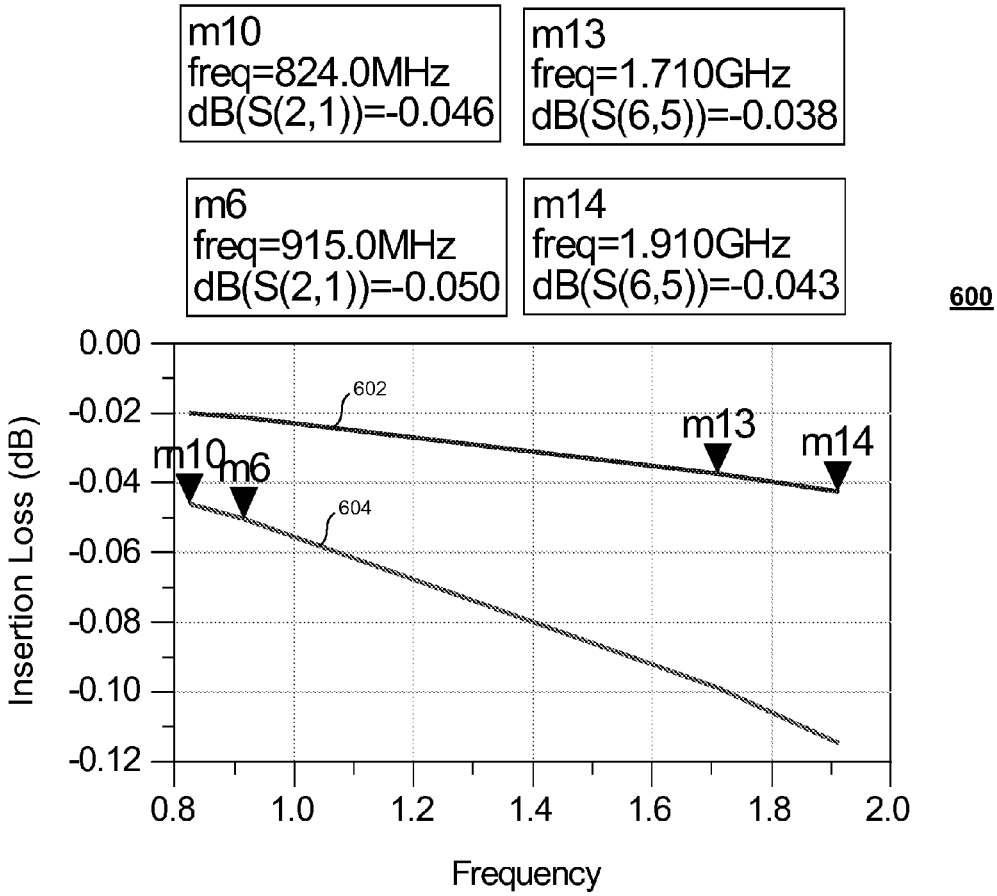
FIG. 6 is a graph showing insertion loss characteristics of a directional coupler.

FIG. 6 is a graph showing insertion loss characteristics for the directional coupler implementation of FIGS. 2A and 2B. In particular, graph 600 includes two curves indicating insertion loss across a range of frequencies from approximately 0.8 GHz to approximately 2.0 GHz. For instance, graph 600 includes a curve 602 indicating insertion loss when input signals are received at conductive pattern 202*c* (e.g., high band signals). Also, graph 600 includes a curve 604 indicating insertion loss when input signals are received at conductive pattern 202*a* (e.g., low band signals). These results were obtained through computer simulation.

As shown in FIG. 6, curve 602 includes a data point m13 indicating an insertion loss of −0.038 dB at 1.710 GHz, and a data point m14 indicating an insertion loss of −0.043 dB at 1.910 GHz. Also, curve 604 includes a data point m10 indicating an insertion loss of −0.046 dB at 824.0 MHz, and a data point m6 indicating an insertion loss of −0.050 dB at 915.0 MHz.

Figure 7:
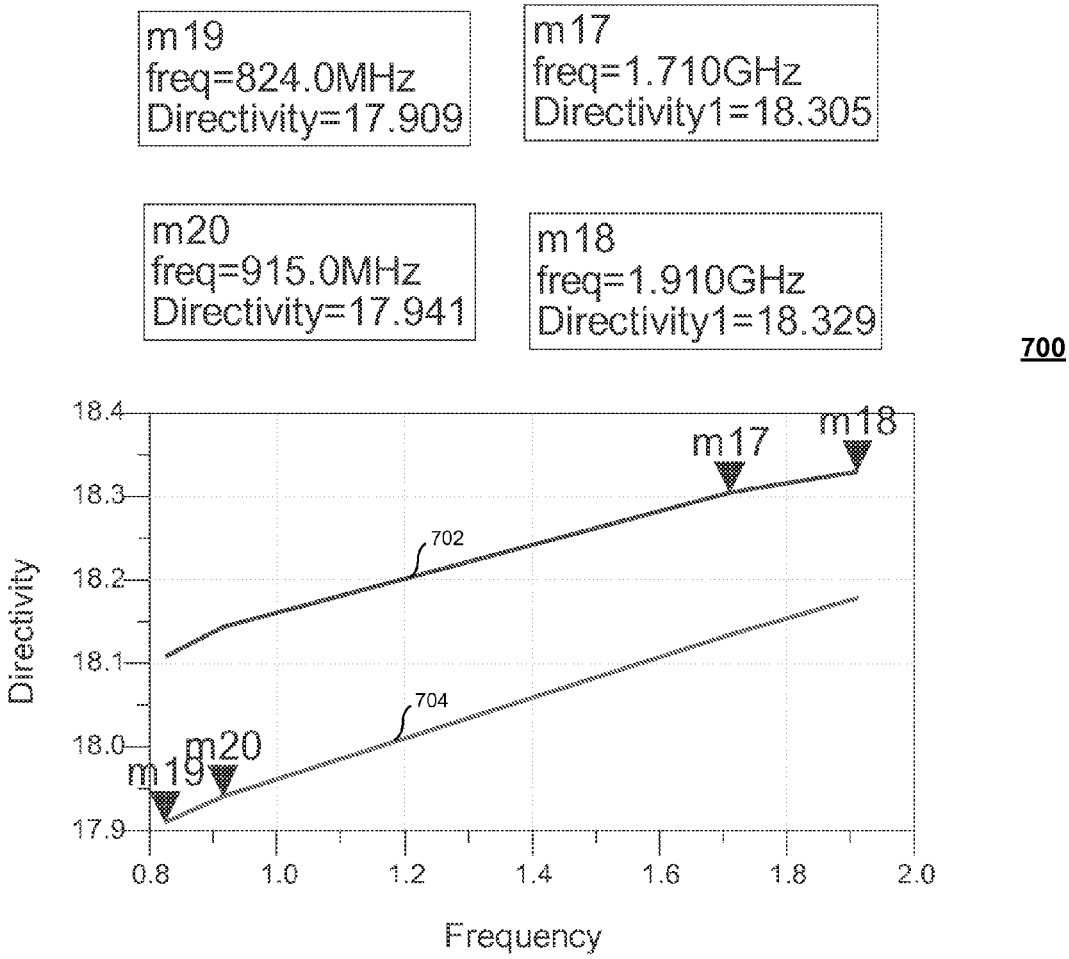
FIG. 7 is a graph showing directivity characteristics for a directional coupler.

FIG. 7 is a graph showing directivity characteristics for directional couplers. In particular, graph 700 includes two curves indicating directivity across a range of frequencies from approximately 0.8 GHz to approximately 2.0 GHz. For instance, graph 700 includes a curve 702 indicating directivity when input signals are received at conductive pattern 202*c* (e.g., high band signals). Also, graph 700 includes a curve 704 indicating insertion loss when input signals are received at conductive pattern 202*a* (e.g., low band signals). These results were obtained through computer simulation.

As shown in FIG. 7, curve 702 includes a data point m17 indicating a directivity of 18.305 dB at 1.710 GHz, and a data point m18 indicating a directivity of 18.329 dB at 1.910 GHz. Also, curve 704 includes a data point m19 indicating a directivity of 17.909 dB at 824.0 MHz, and a data point m20 indicating a directivity of 17.941 dB at 915.0 MHz.

FIGS. 5-7 show that embodiments provide high levels of directivity and low levels of insertion loss The high levels of directivity provide for robust performance under load variations and in the presence of interfereing signals (e.g., interfering signals from an antenna). In contexts, such as the transmitter modules of FIGS. 1 and 4, these features advantageously provide for stable and controllable closed loop power control operations to be maintained. The low levels of insertion loss mitigate problematic efficiency losses associated with an additional isolator element.

FIGS. 5-7 show that embodiments may operate in various frequency bands. Such bands may include: the Advanced Mobile Phone System (AMPS) band, the European GSM/EDGE band, the PCS band, and the European DCS1800 band. Mixers and devices having communications capabilities in these bands are referred to as being quad-band capable. The embodiments, however, are not limited to operation in these frequency bands.

The embodiments described above provide two through lines. For example, the coupler of FIGS. 2A and 2B include a first through line for low band signals and a second through line for high band signals. However, embodiments may include other numbers of through lines. For instance, examples of single through lines are illustrated in FIGS. 8A-8B and 9A-9B.

Figure 8A:
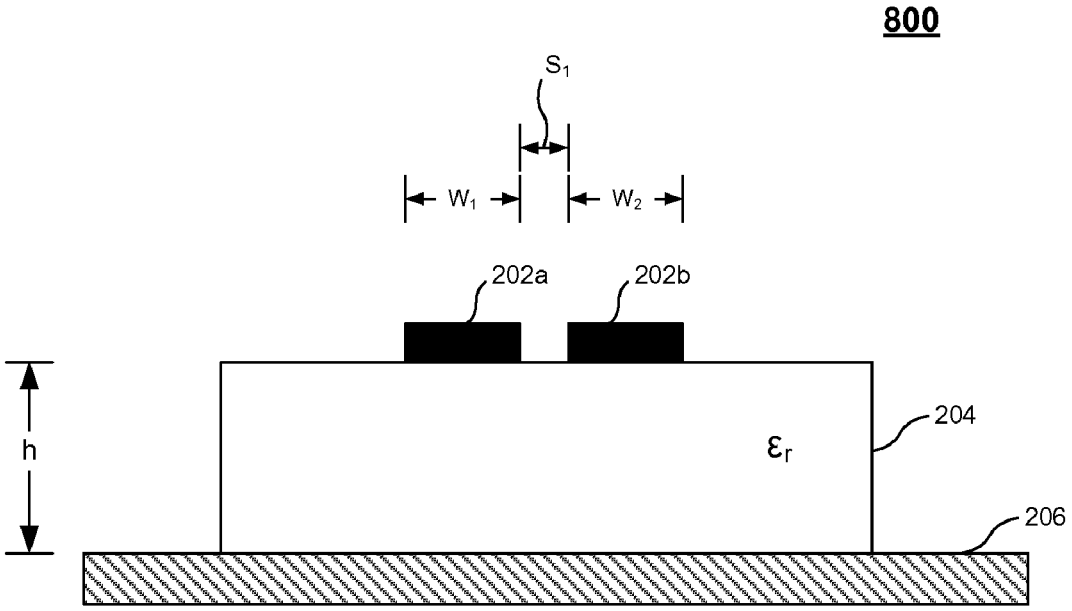
FIGS. 8A and 8B are views of a further directional coupler.
Figure 8B:
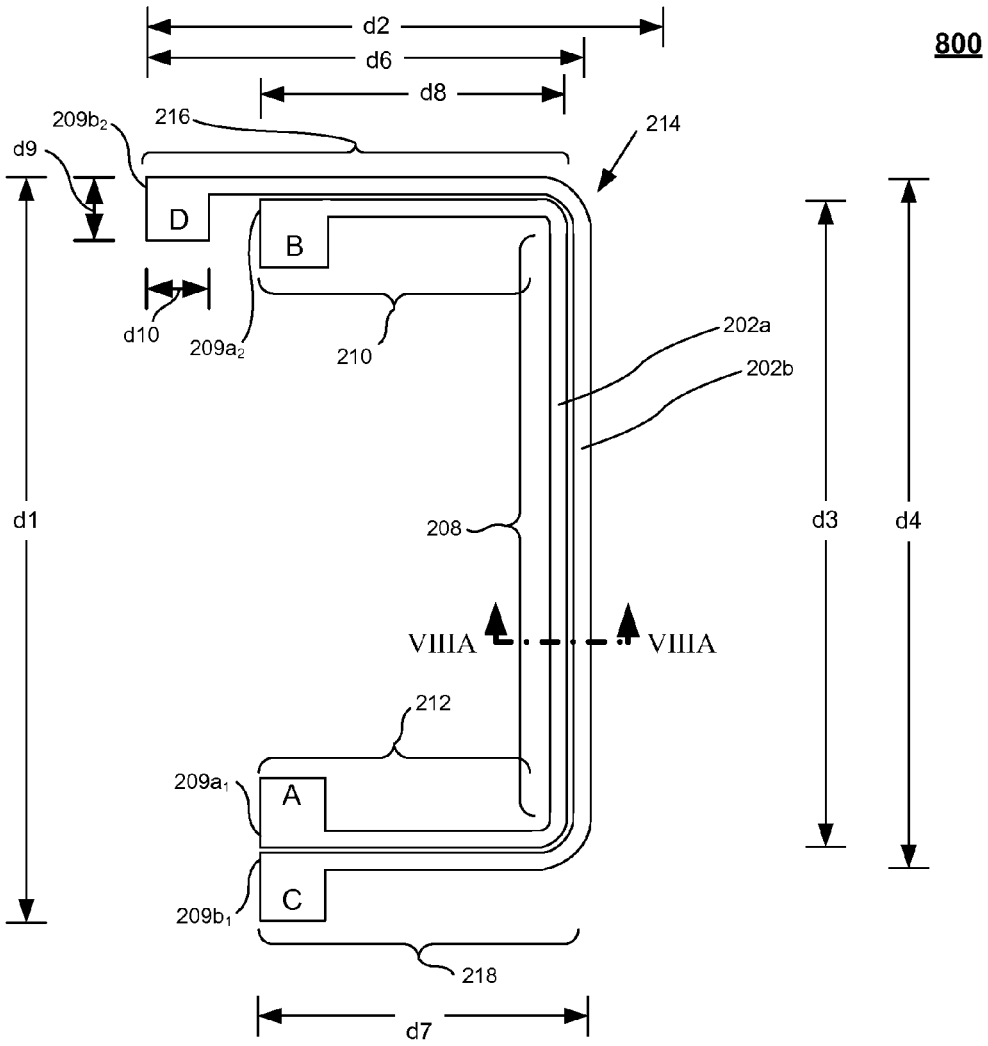

FIGS. 8A and 8B are views of a microstrip directional coupler embodiment 800 having a single through line. In particular, FIG. 8A is a cross-sectional view of coupler embodiment 800, and FIG. 8B is a top layout view of coupler embodiment 800. Coupler embodiment 800 is similar to the embodiment of FIGS. 2A and 2B. However, coupler embodiment 800 does not include conductive pattern 202*c*. Thus, conductive pattern 202*a* provides a single through line for embodiment 800.

As shown in FIGS. 8A and 8B, coupler embodiment 800 may employ dimensions and parameters of embodiment 200 (e.g., height h, widths $W_1$ and $W_2$, spacing $S_1$, $\in_r$, as well as the applicable dimensions described above with reference to FIG. 2B). The embodiments, however, are not limited to these parameters and dimensions.

Figure 9A:
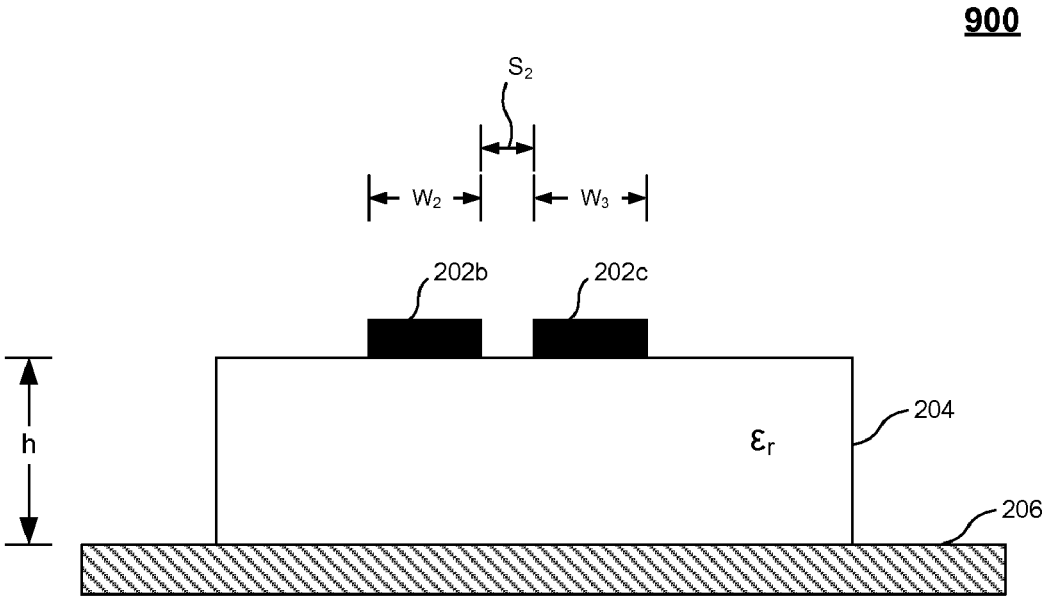
FIGS. 9A and 9B are views of yet a further directional coupler.
Figure 9B:
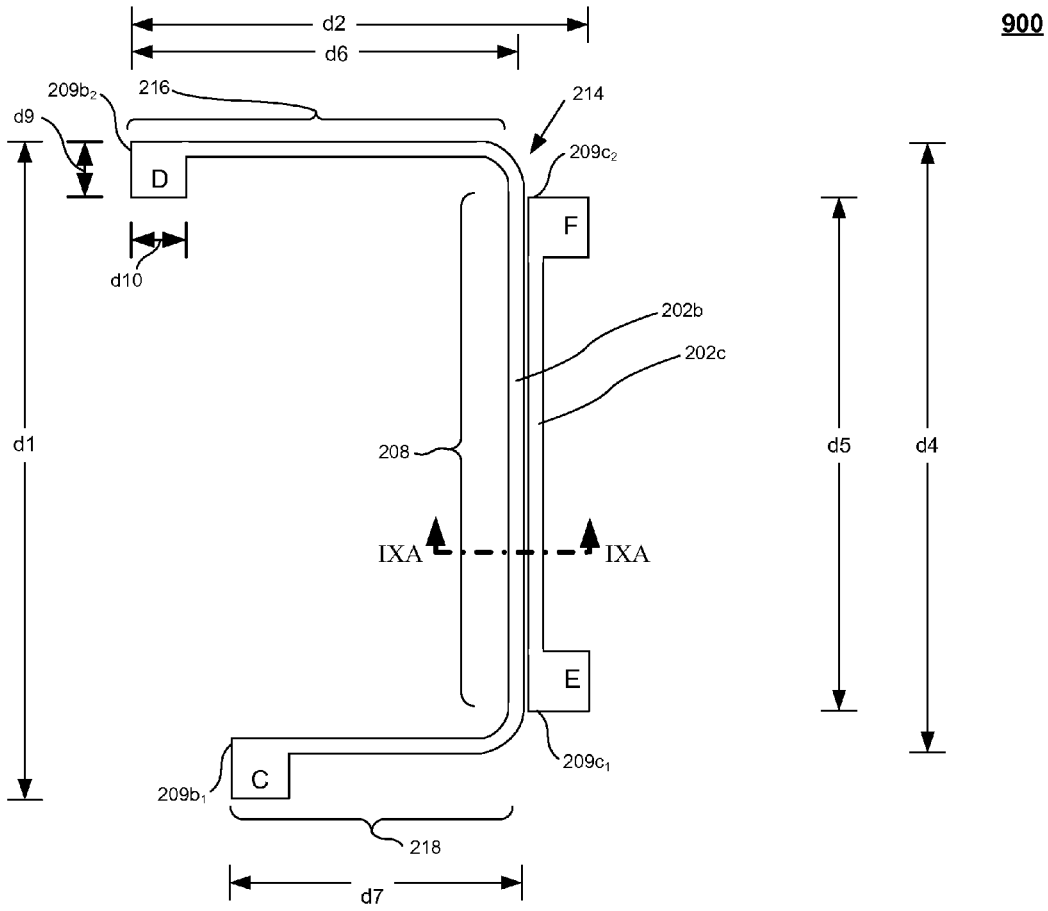

FIGS. 9A and 9B are views of a further microstrip directional coupler embodiment 900 having a single through line. In particular, FIG. 9A is a cross-sectional view of coupler embodiment 900, and FIG. 9B is a top layout view of coupler embodiment 900. Coupler embodiment 900 is similar to the embodiment of FIGS. 2A and 2B. However, coupler embodiment 900 does not include conductive pattern 202*a*. Thus, conductive pattern 202*c* provides a single through line for embodiment 900.

As shown in FIGS. 9A and 9B, coupler embodiment 900 may employ dimensions and parameters of embodiment 200 (e.g., height h, widths $W_2$ and $W_3$, spacing $S_2$, $\in_r$, as well as the applicable dimensions described above with reference to FIG. 2B). The embodiments, however, are not limited to these parameters and dimensions.

While various embodiments of the present invention have been described above, it should be understood that they have been presented by way of example only, and not in limitation.

Accordingly, it will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

The invention claimed is:

1. An apparatus, comprising:

a substrate; and first, second, and third conductive patterns disposed on the substrate, each of the first, second, and third conductive patterns having a first end and an opposite second end;

wherein each of the conductive patterns includes a first protrusion at its first end and a second protrusion at its second end, and wherein each of the first and second protrusions has a rectangular shape.

2. The apparatus of claim 1, further comprising:

a ground plane;

wherein the substrate is between the ground plane and conductive patterns.

3. The apparatus of claim 1, wherein the substrate comprises a semiconductor material.

4. The apparatus of claim 1, wherein the substrate is a Gallium Arsenide (GaAs) substrate.

5. The apparatus of claim 1, wherein the third conductive pattern is arranged between the first and second conductive patterns.

6. The apparatus of claim 5, wherein each of the first and third conductive patterns includes a substantially linear center portion and two opposing side portions, the opposing side portions each substantially linear and substantially perpendicular to their corresponding center portion; and wherein the second conductive pattern is substantially linear.

7. The apparatus of claim 1, wherein the third conductive pattern is to provide a coupled signal at its first end, the coupled signal corresponding to a first signal received at the first end of the first conductive pattern and/or a second signal received at the first end of the second conductive pattern.

8. The apparatus of claim 7, wherein the second end of the third conductive pattern is coupled to a ground node through a terminating resistance.

9. The apparatus of claim 1, wherein the first conductive pattern is to receive a first signal at its first end, and the second conductive pattern is to receive a second input signal at its first end;

wherein the first input signal is within a first frequency range and the second input signal is within a second frequency range; and wherein the first and second frequency ranges are non-overlapping.

10. The apparatus of claim 9, wherein the first frequency is lower than the second frequency range.

11. The apparatus of claim 9, wherein the first frequency range includes an Advanced Mobile Phone System (AMPS) frequency band and a GSM frequency band; and wherein the second frequency range includes the PCS frequency band and a European DCS frequency band.

* * * * *